US010455908B2

(12) United States Patent
Lauper et al.

(10) Patent No.: US 10,455,908 B2
(45) Date of Patent: Oct. 29, 2019

(54) TIMEPIECE OR PIECE OF JEWELLERY MADE OF GOLD

(71) Applicant: The Swatch Group Research and Development Ltd., Marin (CH)

(72) Inventors: Stephane Lauper, Cortaillod (CH); Alban Dubach, Bienne (CH); Denis Vincent, Neuchatel (CH); Edwina Klay, Charmey (CH); Bruno Neveu, Vercel (FR)

(73) Assignee: The Swatch Group Research and Development Ltd., Marin (CH)

( * ) Notice: Subject to any disclaimer, the term of this patent is extended or adjusted under 35 U.S.C. 154(b) by 786 days.

(21) Appl. No.: 14/357,053

(22) PCT Filed: Nov. 7, 2012

(86) PCT No.: PCT/EP2012/071962
§ 371 (c)(1),
(2) Date: May 8, 2014

(87) PCT Pub. No.: WO2013/068365
PCT Pub. Date: May 16, 2013

(65) Prior Publication Data

US 2014/0305164 A1 Oct. 16, 2014

(30) Foreign Application Priority Data

Nov. 8, 2011 (EP) ..... 11188305

(51) Int. Cl.
*C22C 5/02* (2006.01)
*A44C 27/00* (2006.01)
*G04B 37/22* (2006.01)

(52) U.S. Cl.
CPC ..... *A44C 27/003* (2013.01); *C22C 5/02* (2013.01); *G04B 37/22* (2013.01)

(58) Field of Classification Search
CPC ..... C22C 5/02
See application file for complete search history.

(56) References Cited

U.S. PATENT DOCUMENTS 3,136,633 A * 6/1964 Berry ..... B23K 35/3006 162/181.8
2010/0255338 A1 10/2010 Hayakawa et al.

FOREIGN PATENT DOCUMENTS

| | | | |
|---|---|---|---|
| EP | 1 512 766 A1 | | 3/2005 |
| EP | 2 135 972 A1 | | 12/2009 |
| EP | 2 202 330 A1 | | 6/2010 |
| JP | 8-196316 | | 8/1996 |
| JP | 8-325656 | | 12/1996 |
| JP | 08325656 A | * | 12/1996 |
| JP | 10-245646 | | 9/1998 |
| JP | 11-335755 | | 12/1999 |
| JP | 2005-82890 | | 3/2005 |
| JP | 2008-308757 | | 12/2008 |

OTHER PUBLICATIONS

Translation of JP 10-245646 (Japanese document published Sep. 14, 1998).*
International Search Report dated Mar. 28, 2013, in PCT/EP2012/071962, filed Nov. 7, 2012.

* cited by examiner

*Primary Examiner* — Christopher S Kessler
(74) *Attorney, Agent, or Firm* — Oblon, McClelland, Maier & Neustadt, L.L.P.

(57) ABSTRACT

A timepiece or piece of jewellery made of a nickel free and cobalt free gold alloy, the composition of which includes by weight between 75% and 77.5% gold, between 1.2 and 1.6% palladium, and between 20.1 and 23.8% copper.

18 Claims, 3 Drawing Sheets

TIMEPIECE OR PIECE OF JEWELLERY MADE OF GOLD

CROSS-RERFERENCE TO RELATED APPLICATIONS

This is a National Phase Application in the United States of International Patent application PCT/EP2012/071962 filed Nov. 7, 2012 which claims priority on European Patent Application No. 11188305.4 filed Nov. 8, 2011. The entire disclosures of the above patent application are hereby incorporated by reference.

FIELD OF THE INVENTION

The invention concerns a timepiece or piece of jewellery made of a gold alloy.

The invention also concerns a gold-based alloy, called 18 carat red gold and more particularly an alloy of this type having improved discolouration properties.

The invention concerns the field of the metallurgy of gold alloys for horology and jewellery.

BACKGROUND OF THE INVENTION

Standard 5N red gold according to ISO standard 8654 (composition: Au750Cu205Ag45) is currently the most used alloy in the timepiece market, particularly for making external timepiece parts, typically watch cases, bracelets, etc. Unfortunately, this red gold alloy, which has an interesting attractive appearance, discolours over time and slowly changes from its initial red colour to yellow. This phenomenon frequently leads to claims from clients who are dissatisfied with this transformation. The cause of the discolouration is the selective dissolution of Cu close to the surface causing an increase in the concentration of Au at the surface which turns the alloy yellow. There is already known from EP Patent Application No. 1512766A1, a red gold alloy with added platinum, which increases resistance to discolouration compared to prior red gold alloys. However, although more slowly, this gold alloy also exhibits a colour change which can be improved in certain wear conditions, such as when it is subjected to perspiration or acid rain. Further, it is known that platinum is an element with a very high melting point (1768° C.) requiring preparations of mixtures with other specific elements (Au and/or Cu) to lower its melting temperature, which makes the implementation of the alloy more complicated and more expensive. Indeed, without the addition of these alloy elements, platinum does not dissolve homogeneously in gold and makes it mechanically more difficult to deform for certain horological applications.

Thus, platinum remains a very expensive material which increases the cost of the alloy.

SUMMARY OF THE INVENTION

It is therefore an object of the present invention to overcome the aforementioned drawbacks of the prior art by providing a timepiece or piece of jewellery made of an 18 carat red gold alloy exhibiting improved resistance to discolouration compared to the typically 5N prior art red gold alloys.

It is also an object of the invention to provide a timepiece or a piece of jewellery made of an 18 carat red gold alloy with alloy preparations having lower melting points in order to facilitate implementation of the alloy.

It is also an object of the invention to provide a timepiece or piece of jewellery made of an 18 carat red gold alloy having lower alloy costs.

The invention therefore concerns a timepiece or piece of jewellery made of a nickel free and cobalt free gold alloy, whose composition by weight comprises between 75% and 77.5% gold, between 1.2 and 1.6% palladium and between 20.1 and 23.8% copper.

The invention also concerns an 18 carat red gold based alloy, characterized in that it is formed of a mixture comprising by weight:

between 75% and 77.5% gold, 1.2% to 1.6% palladium, 20.1% to 23.8% copper, and does not include nickel or cobalt.

Advantageously, the gold-based alloy (including that of the timepiece of the invention) comprises between 1.35 and 1.45% and preferably 1.4% by weight palladium.

Preferably, the gold-based alloy (including that of the timepiece of the invention) further includes between 0.45 and 2% by weight of an element selected from among iron, zinc, silver and indium or a combination of said elements.

According to a preferred embodiment, the gold-based alloy (including that of the timepiece of the invention) includes 0.48% by weight platinum.

According to another preferred embodiment, the gold-based alloy (including that of the timepiece of the invention) further includes 1.81% by weight silver.

Advantageously, the gold-based alloy (including that of the timepiece of the invention) further includes at most 1% by weight of any one element or of a combination of elements selected from the group including gallium, magnesium, calcium, lithium, aluminium, sodium, titanium, molybdenum, tin, silicon, rhodium, zirconium, potassium and chromium.

Preferably, the gold-based alloy (including that of the timepiece of the invention) includes at most 0.05% by weight iridium, rhenium, or ruthenium and advantageously the alloy includes 0.01% by weight iridium.

It was observed that the timepieces or pieces of jewellery as defined by the annexed claims are very advantageous as regards their colour, brilliance and price.

BRIEF DESCRIPTION OF THE DRAWINGS

Other features and advantages of the invention will appear upon reading the following detailed description, with reference to the annexed drawings, in which.

Table 1 shows example alloy compositions in weight % o according to the invention with the exception of alloys N°103 and N°113 which respectively represent prior art 18 carat red gold alloy compositions.

TABLE 1

| N° | Au. | Pd. | Cu. | Pt. | Ag. | Ir. |
|---|---|---|---|---|---|---|
| 126 | 773.9 | 14.0 | 212.0 | | | 0.1 |
| 128 | 769.1 | 14.0 | 212.0 | 4.8 | | 0.1 |
| 129 | 751.0 | 14.0 | 212.0 | 4.8 | 18.1 | 0.1 |
| 139 | 751.0 | 14.0 | 216.8 | | 18.1 | 0.1 |
| 103 | 750.7 | | 204.3 | | 45 | |
| 113 | 765 | | 210 | 25 | | |

Each of these gold alloys was subjected to three discolouration tests, respectively in a saturated sodium chloride solution, in an artificial sweat solution and in an acid rain solution. The discolouration of each alloy was then measured. Table 2 sets out the composition of the test solutions and the thermal conditions in which they were used. The "artificial sweat" and "acid rain" test compositions represent the conditions that a timepiece may experience during wear in the climatic conditions of areas of Asia.

TABLE 2

| Test | Temperature [° C.] | Formula |
|---|---|---|
| Saturated NaCl | 70 | Deionized Water dl<br>NaCl to saturation (at 70° C.) |
| Artificial sweat | 40 | « Citizen type» acid sweat<br>Deionized Water dl<br>Sodium chloride: 9.9 g/l<br>Sodium sulphide: 0.8 g/l<br>Urea: 1.7 g/l<br>Lactic acid: 1.4 ml/l<br>Sucrose: 0.2 g/l<br>Ammonia solution $NH_3 \bullet H_20$: 0.22 ml/l<br>Hydrochloric acid: quantity necessary to bring the pH to 3.6 (at 25° C.) |
| Acid rain | 70 | Composition« Hangzou« (pH = 4.5):<br>Deionized Water dl<br>NaF: 5.8 μmol/l.<br>$MgCl_2$: 7.1 μmol/l<br>$CaSO_4$: 52 μmol/l<br>$KNO_3$ 5 μmol/l<br>$HNO_3$: 31.4 μmol/l<br>$(NH_4)SO_4$: 40 μmol/l<br>$Na_2SO_4$: 18 μmol/l |

The three discolouration tests were performed on gold alloy washers having a diameter of 20 mm and a thickness of 2.5 mm. The washers were polished in succession with 320, 600, 1200, 2400 grit sandpaper up to felt containing diamond particles of 3 to 1 μm mean diameter.

Each washer was immersed in 200 ml of a solution corresponding to the tests set out in Table 2 for 42 days. Each washer was placed at the bottom of a closed vial (Ø65 mm, made of polypropylene). For statistical reasons, 3 washers of each alloy from Table 1 were tested for each of the three tests.

The washers were removed and rinsed to measure discolouration at different times during the test period and to observe the evolution of discolouration. It was then possible to draw the curves of FIGS. 1 to 3.

The change in colour or discolouration ΔEi after i days was calculated in accordance with the following formula:

$$\Delta E_i = \sqrt{(L_i^* - L_0^*)^2 + (a_i^* - a_0^*)^2 + (b_i^* - b_0^*)^2}.$$

where L*, a*, b* are colorimetric values of samples measured with a "Varian Cary 1E" spectrophotometer with an integrating sphere of 70 mm.

Figure 1:
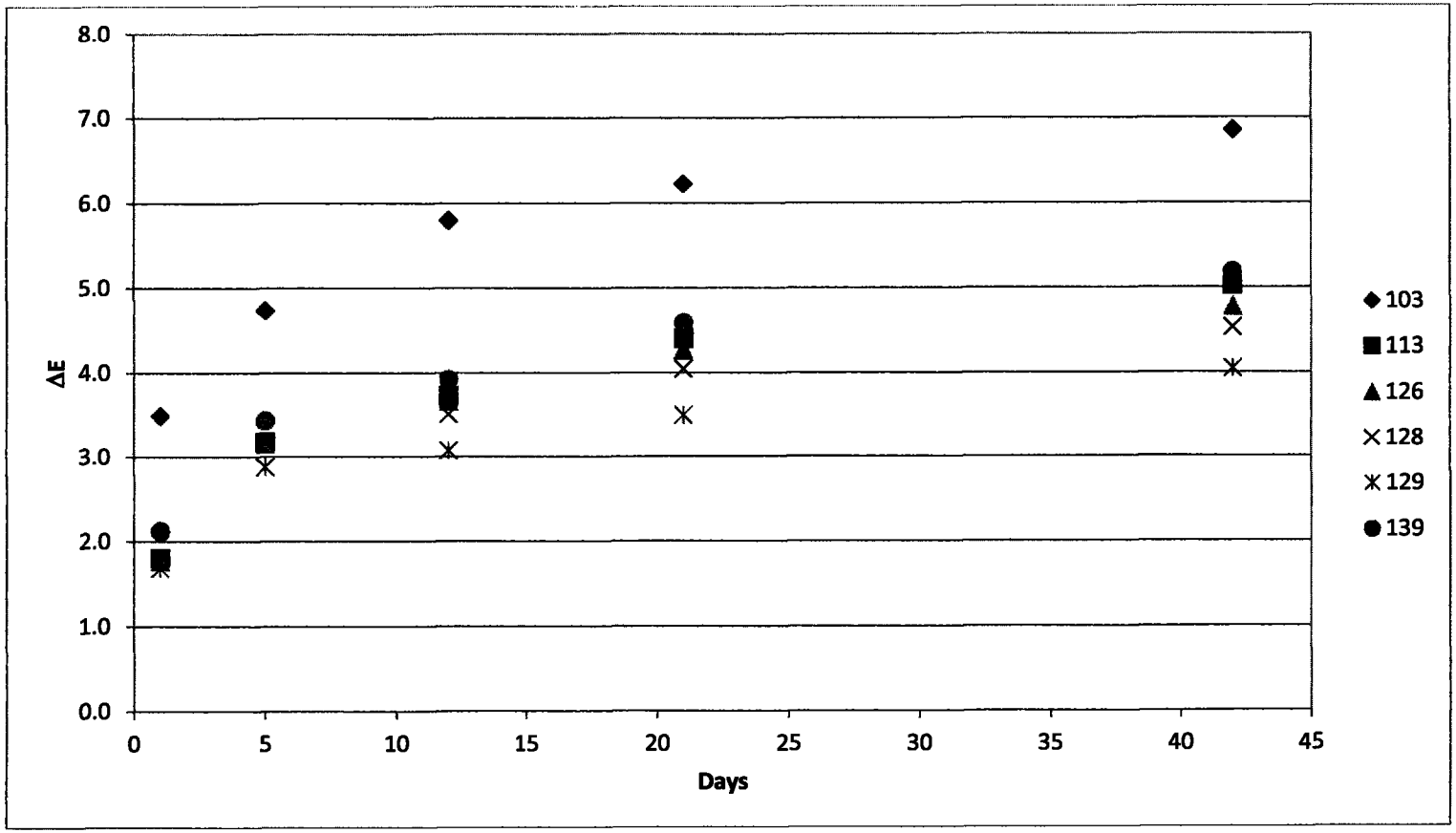
FIG. 1 shows the change in colour ΔE for alloys N°126, N°128, N°129 an N°139 and two prior art 18 carat red gold alloys, namely alloys N°113 and N°103, with time in a saturated NaCl solution test at 70° C.

The results of the discolouration test in saturated NaCl solution at 70° C. show that the red gold alloys according to the invention, alloys N°126, N°128, N°129 and N°139, discolour considerably more slowly than the prior art 18 carat red gold alloy N°103 in this saline atmosphere. These results are illustrated in FIG. 1, which shows that the variation in ΔE between prior art alloy N°103 and alloy N°129 according to the invention evolves from 1.5 after 2 days to virtually 3 after a period of 42 days.

Figure 2:
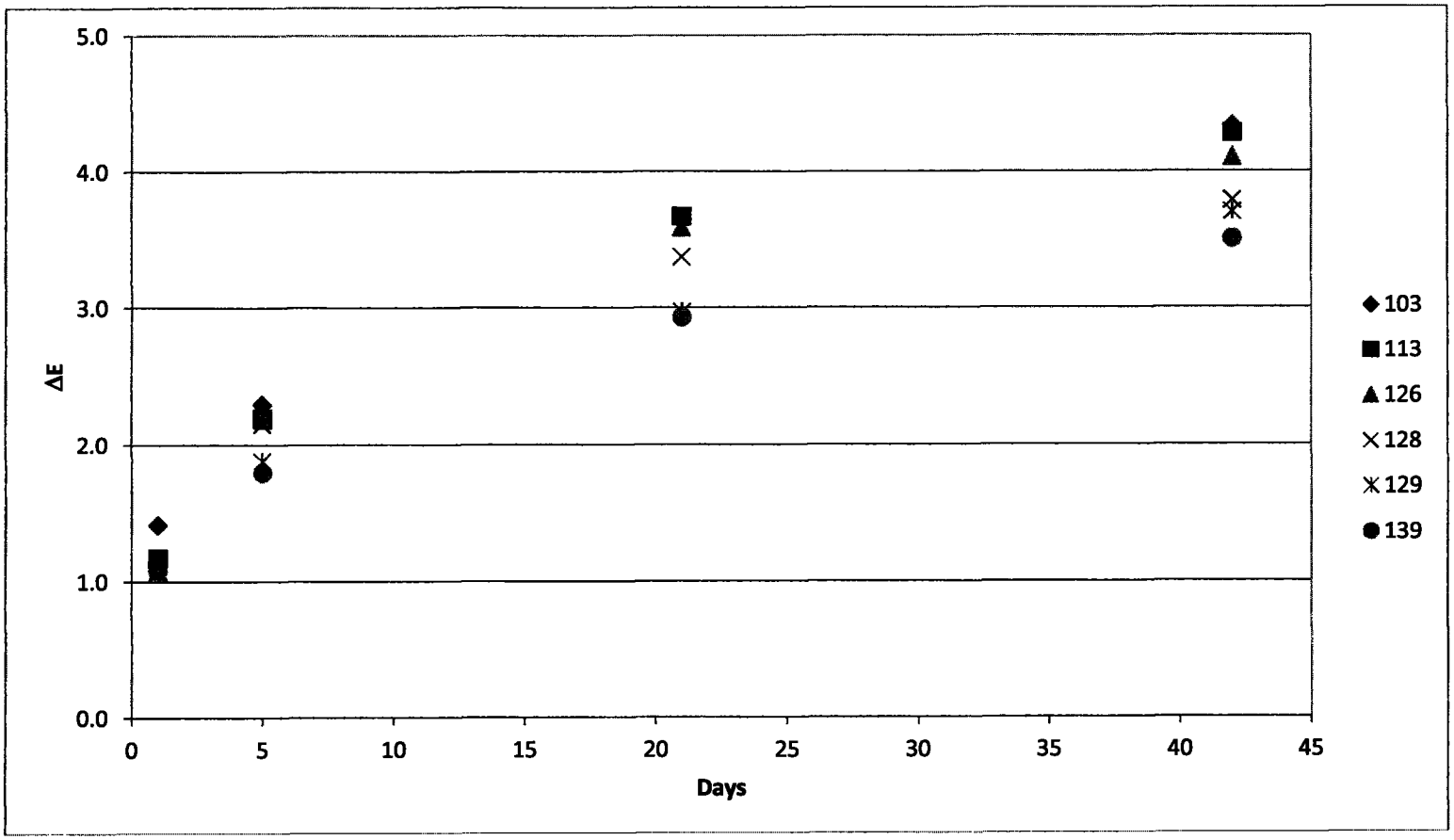
FIG. 2 shows the change in colour ΔE for alloys N°126, N°128, N°129 and N°139 and two prior art 18 carat red gold alloys, namely alloys N°113 and N°103, with time in an artificial sweat test at 40° C.

The results of the discolouration test in the artificial sweat solution at 40° C. show that the red gold alloys according to the invention, alloys No 126, N°128, N°129 and N°139, discolour considerably more slowly than the prior art 18 carat red gold alloy N°103 in this atmosphere of sweat. These results are illustrated in FIG. 2, which shows that the variation in ΔE between prior art alloy N°103 and alloy N°129 according to the invention evolves from 0.4 after 2 days to virtually 0.8 after a period of 42 days.

Figure 3:
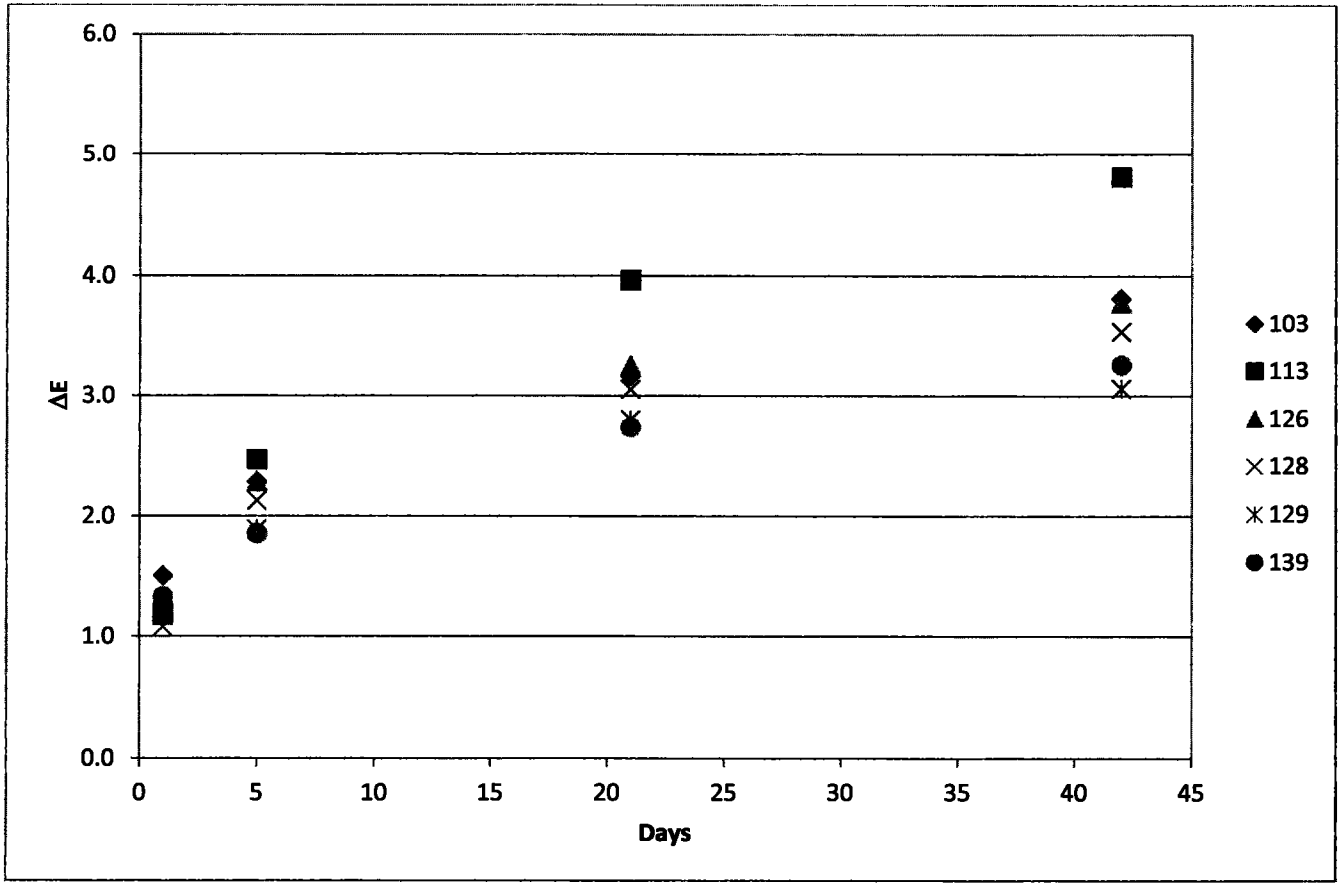
FIG. 3 shows the change in colour ΔE for alloys N°126, N°128, N°129 and N°139 and two prior art 18 carat red gold alloys, namely alloys N°113 and N°103, with time in an acid rain test at 70° C.

The results of the discolouration test in the acid rain solution at 70° C. show that the red gold alloys according to the invention, alloys N°126, N°128, N°129 and N°139, discolour considerably more slowly than the prior art 18 carat red gold alloy N°103 in this acid atmosphere. These results are illustrated in FIG. 3, which shows that the variation in ΔE between prior art alloy N°103 and alloy N°129 according to the invention evolves from 0.5 after 5 days to virtually 2 after a period of 42 days.

These tests therefore clearly show that the resistance to discolouration of the alloys according to the invention is considerably improved compared to the prior art 18 carat gold alloys in saline and acid atmospheres and slightly improved in the case of the artificial sweat test.

The invention claimed is:

1. A timepiece or piece of jewellery manufactured in a nickel free and cobalt free gold alloy, a weight percent composition of which comprises:

between 75% and 77.5% gold, between 1.35 and 1.45% palladium, between 20.1 and 23.8% copper, and the nickel free and cobalt free gold alloy further comprises iridium, wherein the nickel free and cobalt free gold alloy includes a resistance to a discoloration that yellows a color of the nickel free and cobalt free gold alloy when the nickel free and cobalt free gold alloy is exposed in at least one of a saline atmosphere, an acid atmosphere, and an atmosphere of sweat, and the resistance to the discoloration of the nickel free and cobalt free gold alloy is greater than that of a 5N red gold alloy according to ISO standard 8654.

2. The timepiece or piece of jewellery according to claim 1, wherein the alloy comprises between 0.45 and 2% by weight of an element selected from among iron, zinc, silver, and indium, or a combination of the elements.

3. The timepiece or piece of jewellery according to claim 2, wherein the alloy comprises 0.48% platinum.

4. The timepiece or piece of jewellery according to claim 3, wherein the alloy comprises 1.81% silver.

5. The timepiece or piece of jewellery according claim 1, wherein the alloy comprises by weight at most 1% of any one element or of a combination of elements chosen from among gallium, magnesium, calcium, lithium, aluminium, sodium, titanium, molybdenum, tin, silicon, rhodium, zirconium, potassium, and chromium.

6. The timepiece or piece of jewellery according to claim 1, wherein the alloy includes a maximum of 0.05% by weight of an element chosen from among iridium, rhenium, ruthenium.

7. The timepiece or piece of jewellery according to claim 6, wherein the alloy comprises 0.01% by weight iridium.

8. The timepiece or piece of jewellery according to claim 1, wherein the alloy comprises 1.4% by weight palladium.

9. The timepiece or piece of jewellery according to claim 1, wherein the resistance to the discoloration of the nickel free and cobalt free gold alloy is greater than that of a gold alloy comprising 75% gold, 20.5% copper, and 4.5% silver by weight, or that of a gold alloy comprising 76.5% gold, 21% copper, and 2.5% platinum by weight.

10. An 18 carat red gold based alloy, formed of a mixture comprising by weight:

between 75% and 77.5% gold, 1.35 and 1.45% palladium, 20.1% to 23.8% copper, and the mixture further comprises iridium and does not include nickel or cobalt, wherein the mixture includes a resistance to a discoloration that yellows a color of the mixture when the mixture is exposed in at least one of a saline atmosphere, an acid atmosphere, and an atmosphere of sweat, and the resistance to the discoloration of the mixture is greater than that of a 5N red gold alloy according to ISO standard 8654.

11. The gold based alloy according to claim 10, wherein the alloy comprises between 0.5% and 2.0% by weight of an element selected from among the group including iron, zinc, silver, and indium, or a combination thereof.

12. The gold based alloy according to claim 11, wherein the alloy includes 0.48% by weight platinum.

13. The gold based alloy according to claim 12, wherein the alloy includes 1.81% by weight silver.

14. The gold based alloy according to claim 10, wherein the alloy includes a maximum of 1.0% by weight of any of elements selected from the group including gallium, magnesium, calcium, lithium, aluminium, sodium, titanium, molybdenum, tin, silicon, rhodium, zirconium, potassium, and chromium.

15. The gold based alloy according to claim 10, wherein the alloy comprises a maximum of 0.5% by weight of any one element or a combination of elements selected from among the group including iridium, rhenium, and ruthenium.

16. The gold based alloy according to claim 15, wherein the alloy includes 0.01% by weight iridium.

17. An 18 carat red gold based alloy, formed of a mixture comprising by weight:

between 75% and 77.5% gold, 1.35 and 1.45% palladium, 20.1% to 23.8% copper, and the mixture further comprises platinum and does not include nickel or cobalt, wherein the mixture includes a resistance to a discoloration that yellows a color of the mixture when the mixture is exposed in at least one of a saline atmosphere, an acid atmosphere, and an atmosphere of sweat, and the resistance to the discoloration of the mixture is greater than that of a 5N red gold alloy according to ISO standard 8654.

18. A timepiece or piece of jewellery manufactured in a nickel free and cobalt free gold alloy, a weight percent composition of which comprises:

between 75% and 77.5% gold, between 1.35 and 1.45% palladium, between 20.1 and 23.8% copper, and the nickel free and cobalt free gold alloy further comprises an element chosen from among iridium, rhenium, and ruthenium, wherein the nickel free and cobalt free gold alloy includes a resistance to a discoloration that yellows a color of the nickel free and cobalt free gold alloy when the nickel free and cobalt free gold alloy is exposed in at least one of a saline atmosphere, an acid atmosphere, and an atmosphere of sweat, and the resistance to the discoloration of the nickel free and cobalt free gold alloy is greater than that of a 5N red gold alloy according to ISO standard 8654.

* * * * *